US005205093A

United States Patent [19]

Schuette

[11] Patent Number: 5,205,093

[45] Date of Patent: Apr. 27, 1993

[54] PRE-MANUFACTURED STEP SUPPORT

[76] Inventor: Gail D. Schuette, Route 2, Box 281A, Watertown, Minn. 55388

[21] Appl. No.: 901,751

[22] Filed: Jun. 22, 1992

[51] Int. Cl.[5] ..... E04F 11/00

[52] U.S. Cl. ..... 52/182; 52/191

[58] Field of Search ..... 52/182, 184, 185, 188, 52/191

[56] References Cited

U.S. PATENT DOCUMENTS

| | | | |
|---|---|---|---|
| 2,021,457 | 11/1935 | MacKenzie | 20/10 |
| 2,518,745 | 8/1950 | Batelia | 228/58 |
| 3,169,997 | 7/1965 | Hager | 52/182 |
| 3,601,221 | 8/1971 | Fuentes | 182/93 |
| 3,667,572 | 6/1972 | Anderson | 182/220 |
| 4,015,687 | 4/1977 | Dean | 182/220 |
| 4,125,175 | 11/1979 | Ernst | 52/182 X |
| 4,367,613 | 1/1983 | Strub | 52/188 |
| 4,422,270 | 12/1983 | Lapointe | 52/182 |
| 4,464,870 | 8/1984 | Crepeau | 52/188 |
| 4,635,416 | 1/1987 | Ayala | 52/188 |
| 4,709,520 | 12/1987 | Vochatzer | 52/191 |
| 4,866,894 | 9/1989 | Brown | 52/182 |
| 4,875,315 | 10/1989 | Champagne | 52/191 X |
| 5,014,475 | 5/1991 | Anderson | 52/182 X |
| 5,123,210 | 6/1992 | Schmidt | 52/182 |

*Primary Examiner*—Richard E. Chilcot, Jr.
*Assistant Examiner*—Beth A. Aubrey
*Attorney, Agent, or Firm*—Kinney & Lange

[57] ABSTRACT

A step support used in the construction of a staircase that can be attached to a stringer and is capable of securely supporting a step. The apparatus comprises a relatively thin first side member, a relatively thin second side member and a filler block. The filler block is smaller than the first and second side members and is attached between them so that there is a gap between the first side member and the second side member. The step support is attached to the stringer so that the stringer fits in the gap and the side members extend over the sides of the stringer. The step support is attached to the stringer through the use of a plurality of fasteners.

10 Claims, 5 Drawing Sheets 10
11
12
14
18
26
28
29
30
44
66
68
76
77
78
81
82
83
84
2
2

PRE-MANUFACTURED STEP SUPPORT

BACKGROUND OF THE INVENTION

The present invention relates to a step support used in the construction of a staircase and, in particular, to a pre-manufactured step support that fits over a standard stringer to support the treads and risers of a staircase.

Many staircases are constructed by using elongated stringers, which slope downward from an upper level to a lower level, to support the steps of the staircase. A plurality of step supports are usually attached to the stringers to support the steps. There are many types of step supports used including many forms of metal brackets as well as wooden supports that rest on top of the stringers.

The Champagne U.S. Pat. No. 4,875,315 shows a typical type of step support, where the support is attached to an upper surface of the stringer. A problem with this type of step support can occur when a large lateral stress is applied to the step, and the step can become loosened or misaligned in the lateral direction. The Ayala U.S. Pat. No. 4,635,416 shows a step support comprising a metal bracket that fits over the stringer, providing support for lateral stresses. However, this step support has the problem of relying on its attaching means, which are mostly at one end, to support the bracket on the stringer. The application of large vertical stresses to the Ayala step support can therefore result in the step becoming loosened or misaligned in the vertical direction.

There is therefore a need for a step support which can be attached to a stringer in a manner allowing it to securely support a step subject to large stresses in both the vertical and lateral directions. In addition, it is advantageous to have a step support having a design that allows the support to be inexpensively made from readily available materials.

SUMMARY OF THE INVENTION

The present invention provides a step support which can be securely attached to a stringer in a manner which prevents both vertical and lateral stresses from causing the step support to become loosened. In addition, the step support of the present invention can be inexpensively constructed using readily available materials such as plywood. Plywood that is in small pieces can be used.

The step support comprises a relatively thin first side member, a relatively thin second side member, a filler block positioned between the side members and a plurality of support fasteners. The first side member, the second side member and the filler block each have an upper surface that is perpendicular to a first end surface. The filler block has a diagonal surface opposite its upper and first end surfaces and cut at an angle relative to a horizontal plane substantially equal to that of the stringer to which the step support is attached.

The filler block is placed between the first side member and the second side member such that the upper and first end surfaces of each side member are flush with those of the filler block. The first side member, the second side member and the filler block are attached together through the use of the support fasteners.

The step support is attached to the stringer so that the first side member and the second side member extend over opposite sides of the stringer and the diagonal surface of the filler block faces an upper surface of the stringer. The step support is attached to the stringer through the use of a plurality of stringer fasteners.

DETAILED DESCRIPTION OF THE PREFERRED EMBODIMENTS

Figure 1:
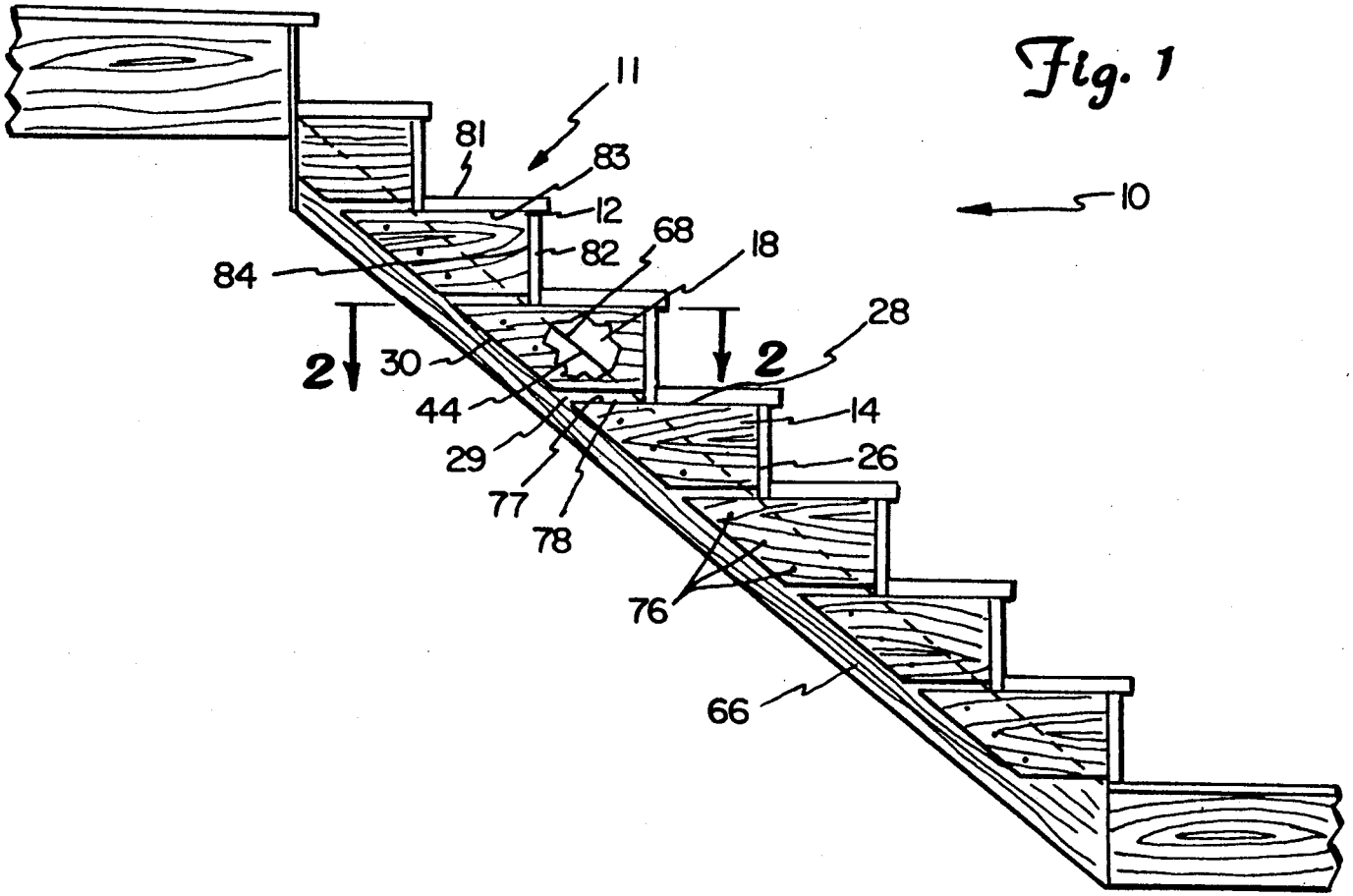
FIG. 1 is a side view of a part of a staircase with the step support of the present invention.

A staircase 10 having a plurality of steps 11 with a step support 12 of the present invention is shown in FIG. 1. The step support 12 is shown in more detail in FIG. 4 and comprises a first side member 14, a second side member 16 and a filler block 18. The filler block 18 comprises a first filler piece 20 and a second filler piece 22 and is placed between the first side member 14 and the second side member 16. The filler block 18 has the general shape of a triangle and is smaller than both the first side member 14 and the second side member 16, creating a gap 23 between them.

The first side member 14 is fabricated from a relatively thin piece of material such as plywood, and has the general shape of a trapezoid. The first side member 14 has a first end surface 26 which is perpendicular to both an upper surface 28 and a lower surface 29. A second end surface 30 forms an acute angle with the upper surface 28 and an obtuse angle with the lower surface 29.

The second side member 16 is fabricated from a relatively thin piece of material such as plywood, and has the general shape of a trapezoid. The second side member 16 has an upper surface 32 which is perpendicular to both a first end surface 34 and a second end surface 36. A lower surface 38 forms an acute angle with the first end surface 34 and an obtuse angle with the second end surface 36.

Both the first filler piece 20 and the second filler piece 22 are approximately the same size and have the general shape of a triangle, and both are fabricated from material such as plywood. A first side 39 of the first filler piece 20 is attached to a first side 40 of the second filler piece 22 to form the filler block 18. The filler block 18 has an upper surface 41 perpendicular to a first end surface 42, and a diagonal surface 44 forming an acute angle with both the upper surface 41 and the first end surface 42.

Figure 5:
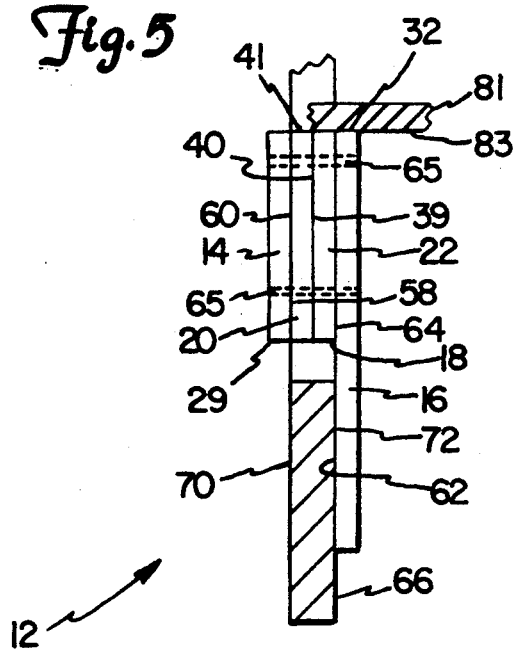
FIG. 5 is a sectional view taken along the line 5—5 of FIG. 4.
Figure 6:
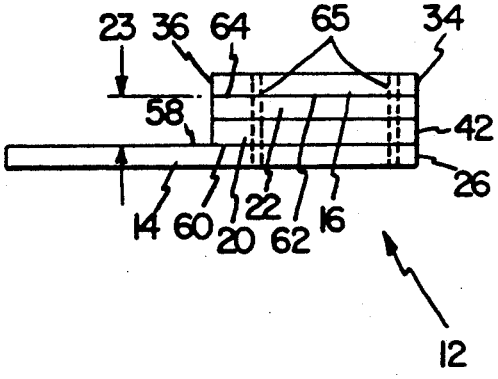
FIG. 6 is a top view of the step support of the present invention.

Referring to FIGS. 5 and 6, a first side 58 of the first side member 14 is attached to a first side 60 of the filler block 18, such that the first end and upper surfaces 26,28 of the first side member 14 are flush with the first end and upper surfaces 42,41 of the filler block 18 respectively. A first side 62 of the second side member 16 is attached to a second side 64 of the filler block 18 such that the first end and upper surfaces 34,32 of the second filler piece 16 are flush with the first end and upper surfaces 42,41 of the filler block 18 respectively. A plurality of support fasteners 65 are inserted through the first side member 14, the second side member 16 and the filler block 18 to hold them together. Glue also can be used for joining the side members and the filler block.

The step support 12 is attached to a stringer 66 so that the diagonal surface 44 of the filler block 18 faces an upper surface 68 of the stringer 66. The first side member 14 extends over a first side 70 of the stringer 66 and the second side member 16 extends over a second side 72 of the stringer 66.

Figure 4:
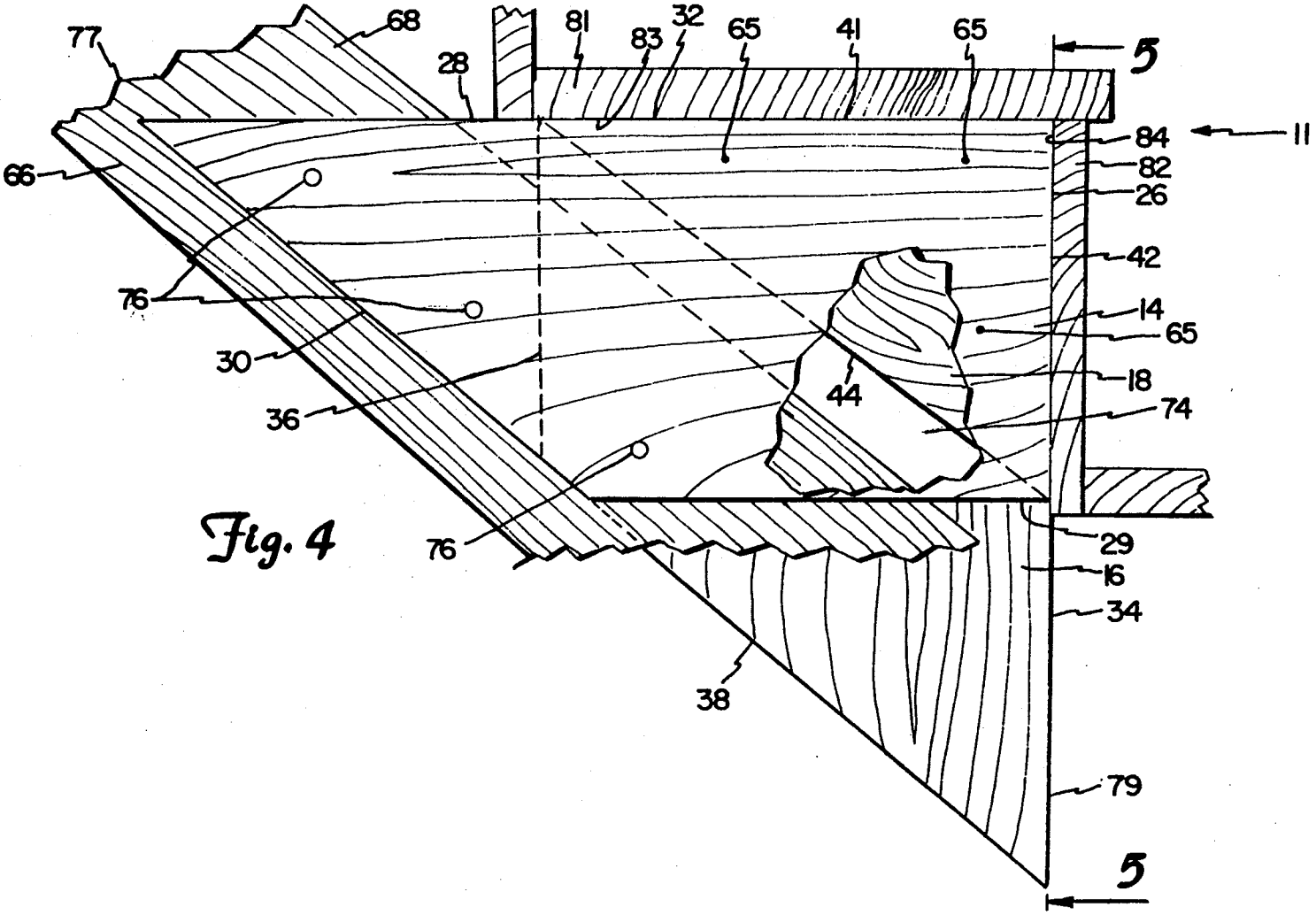
FIG. 4 is a side view of the step support of the present invention.

A space 74 exists between the upper surface 68 of the stringer 66 and the diagonal surface 44 of the filler block 18, and is shown in FIG. 4. The space 74 can be adjusted to a desired depth before the step support 12 is attached to the stringer 66, allowing the depth of the step 11 to be chosen. If desired, the diagonal surface 44 of the filler block 18 can rest on the upper surface 68 of the stringer 66 so that there is no space 74. This provides increased support for vertical stresses. The step support 12 is held in place through the use of a plurality of stringer fasteners 76 which are inserted through both the first side member 14 and the second side member 16 and into the stringer 66.

The first side member 14 of the step support 12 extends over the first side 70 of the stringer 66, and is shown in FIG. 1. The step support 12 is positioned so that a first end 77 of the upper surface 28 faces the lower surface 29 of the first side member 14 of the step support 12 immediately above it, forming a first gap 78 between the step supports 12. The size of the first gap 78 will partly determine both the depth and the height of the step 11.

Figure 3:
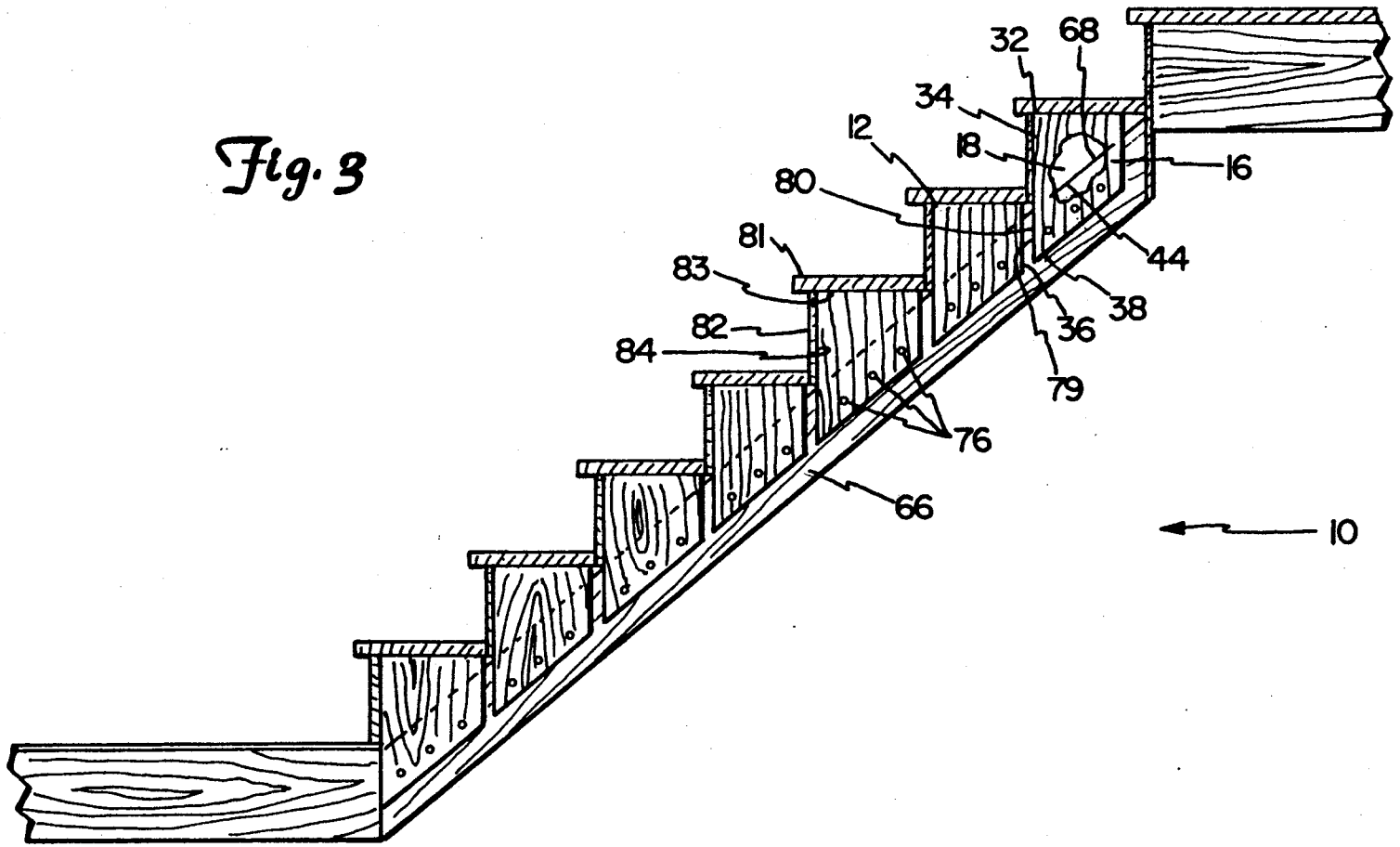
FIG. 3 is a side view of a part of a staircase with the step support of the present invention.

The second side member 16 of the step support 12 extends over the second side 72 of the stringer 66, and is shown in FIG. 3. The step support 12 is positioned so that a first end 79 of the first end surface 34 faces the second end surface 36 of the second side member 16 of the step support 12 immediately below it, forming a second gap 80 between the step supports 12. The size of the second gap 80 will correspond to the size of the first gap 78 and will partly determine the height and the depth of the step 11.

Figure 2:
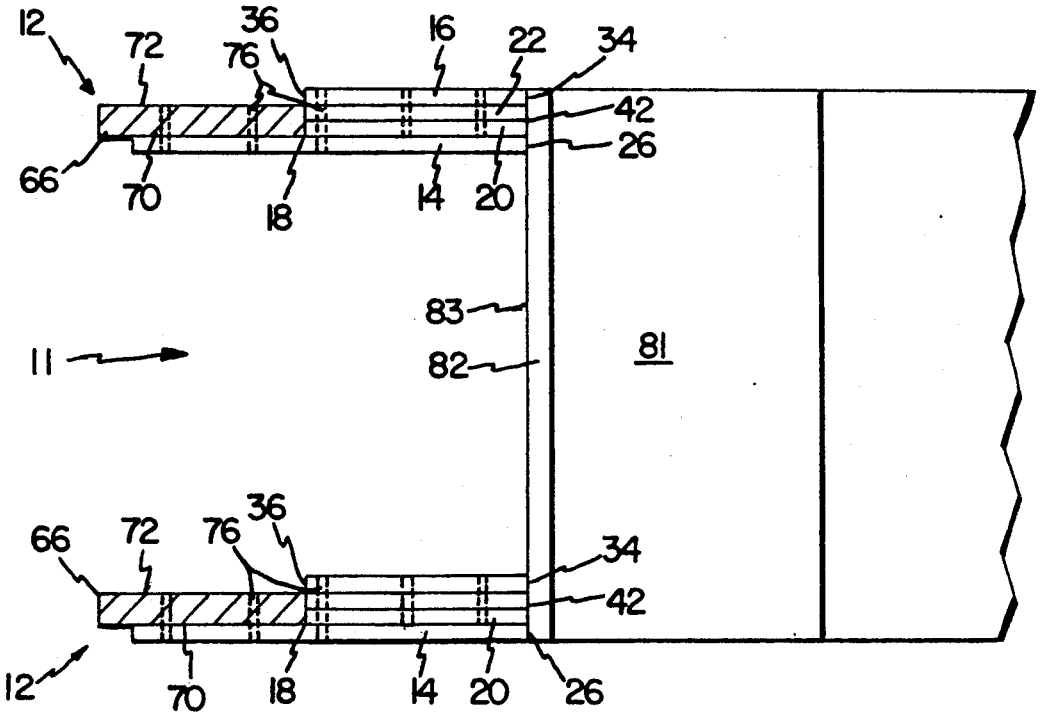
FIG. 2 is a sectional view taken along the line 2—2 of FIG. 1.

The step 11, shown in FIG. 2, comprises a tread 81, a riser 82 and two step supports 12. A bottom side 83 of the tread 81 comes into contact with and is supported by the upper surface 28 of the first side member 14, the upper surface 32 of the second side member 16 and the upper surface 41 of the filler block 18. A first side 84 of the riser 82 comes into contact with and is supported by the first end surface 26 of the first side member 14, the first end surface of the second side member 16 and the first end surface 42 of the filler block 18. The tread 81 and the riser 82 can be attached to the step support 12 through the use of nails, screws, adhesives or other known methods.

Although the filler block 18 is described as comprising two filler pieces 20,22, the filler block 18 can comprise any number of pieces. Further, the filler pieces 20,22, as well as the first side member 14 and the second side member 16, can be fabricated from a material other than plywood.

Figure 7:
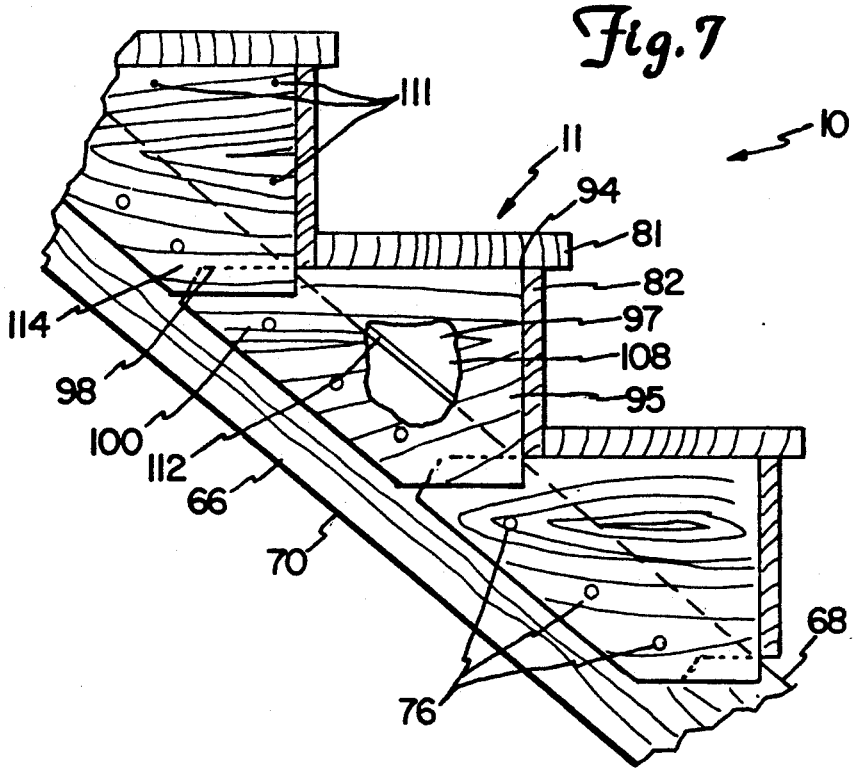
FIG. 7 is a side view of a part of a staircase with an alternative embodiment of the step support of the present invention.
Figure 8:
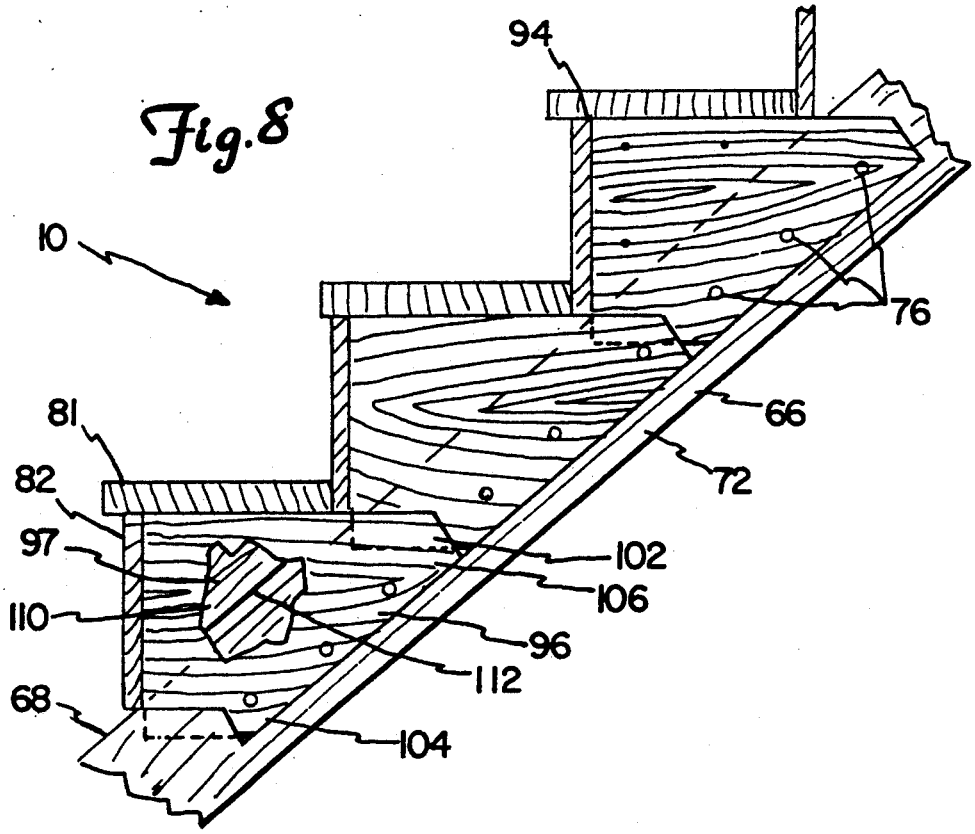
FIG. 8 is a side view of a part of a staircase with an alternative embodiment of the step support of the present invention.

A step support 94 comprising a first side member 95, a second side member 96 and a filler block 97 is shown in FIGS. 7 and 8 in a first alternative embodiment of the present invention. The first side member 95 has the general shape of a trapezoid having a first notch 98 cut in a first end 100. The second side member 96 has the general shape of a trapezoid having a second notch 102 cut in a first end 104 and having a second end 106 that is truncated. The filler block 97 has a size and shape similar to that described in the first embodiment and comprises a first filler piece 108 and a second filler piece 110.

The filler block 97 is attached between the first side member 95 and the second side member 96. In addition, the first side member 95, the second side member 96 and the filler block 97 are attached together so that the upper surfaces of each piece are flush and the first end surfaces of each piece are flush as described in the first embodiment. The pieces are held together through the use of a plurality of support fasteners 111, with adhesives for example.

The step support 94 is attached to the stringer 66 such that the first side member 95 and the second side member 96 extend over the first side 70 and the second side 72 of the stringer 66 respectively. A diagonal side 112 of the filler block 97 faces the upper surface 68 of the stringer 66. A second end 114 of the first side member 95 is received by the first notch 98 of the step support 94 immediately below it. The second end 106 of the second side member 96 is received by the second notch 102 of the step support 94 immediately above it.

The step support 94 is attached to the stringer 66, and the tread 81 and the riser 82 are attached to the step support 94, in the same manner as described in the first embodiment. The first side member 95, the second side member 96 and the filler block 97 can be fabricated from plywood or other similar materials. Finally, although the filler block 97 has been described comprising two filler pieces 108,110, the filler block 97 can comprise any number of pieces.

In a typical step support made of small pieces of plywood which would otherwise be scrap, the side member may be ⅝ inch thick plywood, for example, and the filler block made of two ⅛ inch thick pieces of plywood.

Although the present invention has been described with reference to preferred embodiments, workers skilled in the art will recognize that changes may be made in form and detail without departing from the spirit and scope of the invention.

What is claimed is:

1. A step support for use in constructing a staircase of the type having standard size stringers and a plurality of treads and risers, the step support comprising:

a first side member having a first side upper surface and a first side end surface substantially perpendicular to each other, to support the tread and the riser of a step;

a second side member having a second side upper surface and a second side end surface substantially perpendicular to each other, to support the tread and the riser of a step;

a filler block between the first side member and the second side member having a width equal to that of a standard size stringer, the filler block having a block upper surface substantially flush with the first and second side upper surfaces and a block end surface substantially flush with the first and second side end surfaces, and the filler block having a block support surface between the first side member and the second side member at an angle with respect to the block upper surface substantially equal to the angle of a facing surface of the stringer to which the step support is attached said first and second side members and said filler block being substantially parallel to one another.

2. The step support of claim 1 wherein the first side member has a first side support surface opposite from the first side end surface, and at least a portion of the first side support surface is cut at an angle with respect to the first side upper surface substantially equal to the angle of the block support surface.

3. The step support of claim 2 wherein the second side member has a second side support surface opposite from the second side upper surface, and at least a portion of the second side support surface is cut at an angle with respect to the second side end surface substantially equal to the angle of the block support surface.

4. The step support of claim 3 wherein the first side member has a first side lower surface opposite from the first side upper surface, the first side lower surface being substantially parallel to the first side upper surface.

5. The step support of claim 4 wherein the second side member has a second side second end surface opposite from the second side end surface, the second side second end surface being substantially parallel to the second side end surface.

6. The step support of claim 1 wherein the filler block comprises a plurality of filler layers having the general shape of the filler block.

7. The step support of claim 6 wherein the first side member, the second side member and the filler block are fabricated from plywood.

8. The step support of claim 1 wherein the step support is supportable on a standard size stringer so that the first side member extends over a first side of the stringer and the second side member extends over a second side of the stringer.

9. The step support of claim 8 wherein the first side lower surface faces at least a portion of the first side upper surface of an adjacent step support and the second side second end surface faces at least a portion of the second side end surface of an adjacent step support.

10. The step support of claim 9 wherein the step support is held in place by a plurality of support fasteners.

* * * * *